US005174232A

United States Patent [19]

Boddy

[11] Patent Number: 5,174,232

[45] Date of Patent: Dec. 29, 1992

[54] FRAME FOR INFLATABLE CATAMARAN

[76] Inventor: Graeme J. Boddy, 77 Eastern Terrace, Christchurch, New Zealand

[21] Appl. No.: 750,492

[22] Filed: Aug. 27, 1991

[30] Foreign Application Priority Data

Aug. 29, 1990 [NZ] New Zealand ..... 235079

[51] Int. Cl.[5] ..... B63B 7/08

[52] U.S. Cl. ..... 114/61; 114/345; 114/354

[58] Field of Search ..... 114/61, 345, 354

[56] References Cited

U.S. PATENT DOCUMENTS 4,496,325 1/1985 Tweg ..... 114/61

FOREIGN PATENT DOCUMENTS 2010369 3/1970 Fed. Rep. of Germany ..... 114/345

3445836 6/1986 Fed. Rep. of Germany ..... 114/61

*Primary Examiner*—Sherman Basinger

[57] ABSTRACT

A frame for an inflatable catamaran, consisting of an inner frame each side of which has two pairs of side frames pivoted to it; inflatable tubes forming the hulls of the catamaran are secured on each side of the frame, by securing the side frame to the tubes at spaced apart positions; the frame is arranged to fold substantially flat for storage.

17 Claims, 4 Drawing Sheets

FRAME FOR INFLATABLE CATAMARAN

BACKGROUND OF THE INVENTION

1. Field of the Invention

The present invention relates to a frame for an inflatable catamaran. An inflatable catamaran comprises two spaced inflatable tubes which form the hulls of the boat, the tubes being secured together by a rigid support which generally is in the form of a frame. The frame generally provides one or more seats and possibly also strong-points to which masts or oars or an engine can be secured.

2. Description of the Prior Art

A variety of different catamarans or catamaran type frames have been proposed; for example, U.S. Pat. No. 4,284,024 (Montgomery) discloses a simple form of frame in which a rigid longitudinal beam is secured along the top of each hull and a pair of spaced cross beams are secured between the longitudinal beams, to form a frame. This frame is secured together simply by fastening the components together, so that the frame must be virtually completely dismantled to transport or store the catamaran. A further drawback of this design is that the longitudinal beams are the same length as the hulls, and therefore are over-long for convenient storage or transport.

U.S. Pat. No. 4,348,971, also to Montgomery, discloses a frame consisting of a central torsion beam which extends substantially parallel to the length of the hulls, with cross members secured at right angles to the longitudinal torsion beam, to form a frame. The free ends of the cross members are secured to the hulls. However, this design suffers from the same drawbacks as the earlier Montgomery design enclosed in the U.S. Pat. No. 4,284,024.

U.S. Pat. No. 4,136,414 (Popkin) discloses a design broadly similar to that disclosed in U.S. Pat. No. 4,348,971 in that the frame consists of a central rigid member lying substantially parallel to the spaced hulls, and connected to the hulls by a series of rigid bridging members. In this design, each of the hulls is reinforced by an internal rigid tube which extends substantially the full length of the hull. As with the proposals discussed above, the frame disclosed in U.S. Pat. No. 4,136,414 has to be dismantled for storage or transport, and has the further drawback that the central rigid member is nearly equal to the hulls in length, and cannot be dismantled for storage.

U.S. Pat. No. 4,915,047 (Lord and Collins) discloses a simple generally rectangular frame the sides of which rest on top of the spaced hulls and are secured thereto. The frame includes a large number of components which are push-fitted and pinned together, making assembly/disassembly of the frames relatively complex.

It will be appreciated that, since inflatable catamarans generally are used as recreational boats, and since the whole point of having inflatable hulls is that the hulls can be deflated to a relatively small volume for storage or transport, then it is a considerable advantage if the frame also can be dismantled quickly and easily to a relatively small volume for storage or transport.

U.S. Pat. No. 4,294,184 (Heinrich) which relates to a multi-hull craft rather than to a catamaran as such, discloses a basically triangular frame configuration, in which the spars which extend from the centre hull to the two outer hulls may be pivoted to a position above the centre hull for storage or transport.

However, this frame is attached to the hulls only at a single point on each hull:—thus, the frame does little to stabilise the hulls, and the attachment points tend to be over-stressed, since all the stresses between the frame and the hulls are concentrated at those points.

U.S. Pat. No. 4,930,433 (Tirez) discloses an arrangement in which a frame for joining two surfboards to form a catamaran type of craft has side members which can be pivoted in a horizontal plane for storage or transport of the frame. The pivoting arrangement is such that the frame cannot be collapsed for storage or transport without first detaching the surfboards from the frame. Also, the frame has a geometry which is far from ideal:—the frame members which extend outwards to the outer hulls are secured to those hulls only in a single plane. Thus, the frame is torsionally weak.

BRIEF SUMMARY OF THE INVENTION

It is therefore an object of the present invention to provide a frame for an inflatable catamaran which can be reduced to a size convenient for transport or storage without complete disassembly, and which can be assembled relatively quickly and easily. A further object is the provision of a frame which can stay attached to the inflatable tubes (whether inflated or deflated) of the catamaran during transport and in particular that can fold whilst still attached to the inflated hulls, bringing the hulls close together for transport or storage. A still further object is the provision of a frame which is secured to the inflatable tubes is such a way as to tend to stabilise those tubes against rotation when the craft is in use.

An additional object of the invention is the provision of a frame which is capable of being used either for a catamaran for turbulent waters or for family recreational boating on calm water, and which can be powered by a sail, or a motor or oars.

The present invention provides a frame for an inflatable catamaran, said frame comprising: an inner frame which includes two spaced elongated members forming the sides of said inner frame and two spaced cross-members connecting said sides together; first and second pairs of side frames, each side frame including an elongated member which in use extends parallel to the length of the adjacent inflatable hull; one side frame of each pair being pivoted to one of said sides of said inner frame and the other side frame of each pair being pivoted to the other of said sides of said inner frame, such that the respective side forms the pivot axis; the elongated members of the first pair of side frames being securable one to each of the upper surfaces of the catamaran hulls; and each elongated member of the side frames of the second pair being securable one to each of the catamaran hulls at a position below the securement position of said first pair of side frames; and means for releasably locking said first pair of side frame in position relative to said inner frame.

Said second pair of side frames may be locked relative to said inner frame, but need not be. Advantageously, said second pair of side frames is left free to pivot relative to the remainder of the frame:—this has the advantage of allowing the second side frames to lift with the hulls and so avoid obstacles in shallow water.

Said locking means may comprise a pair of stays secured between the inner frame and said first pair of side frames; alternatively said locking means may comprise a bar or plate or other rigid component, rigidly secured between the inner frame and one pair of side frames.

BRIEF DESCRIPTION OF THE DRAWINGS

Preferred embodiments of the invention are described in detail, with reference to the accompanying drawings, in which.

DETAILED DESCRIPTION OF PREFERRED EMBODIMENTS OF THE INVENTION

Figure 1:
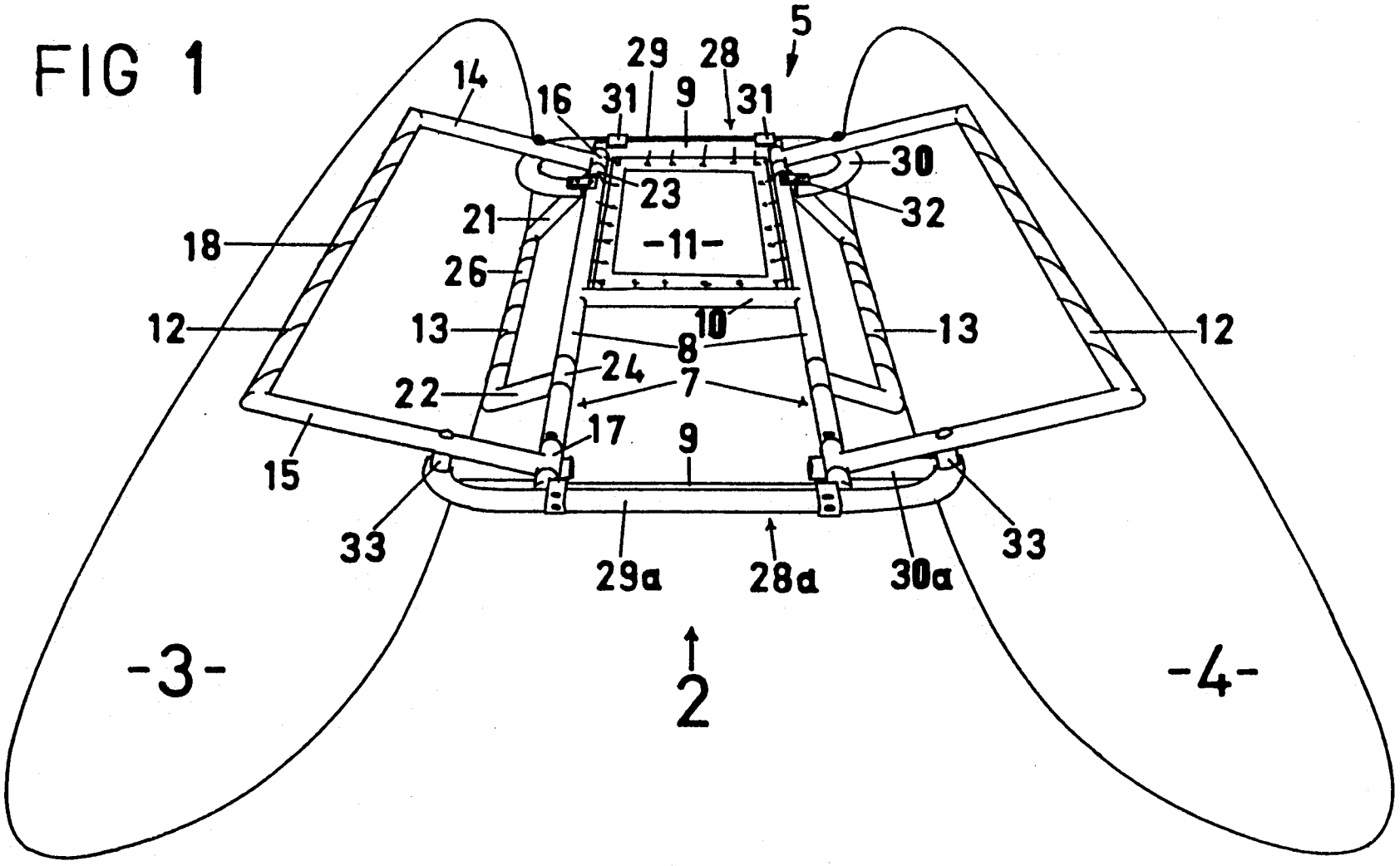
FIG. 1 is an isometric view of an inflated catamaran incorporating a frame in accordance with a first embodiment of the present invention.
Figure 2:
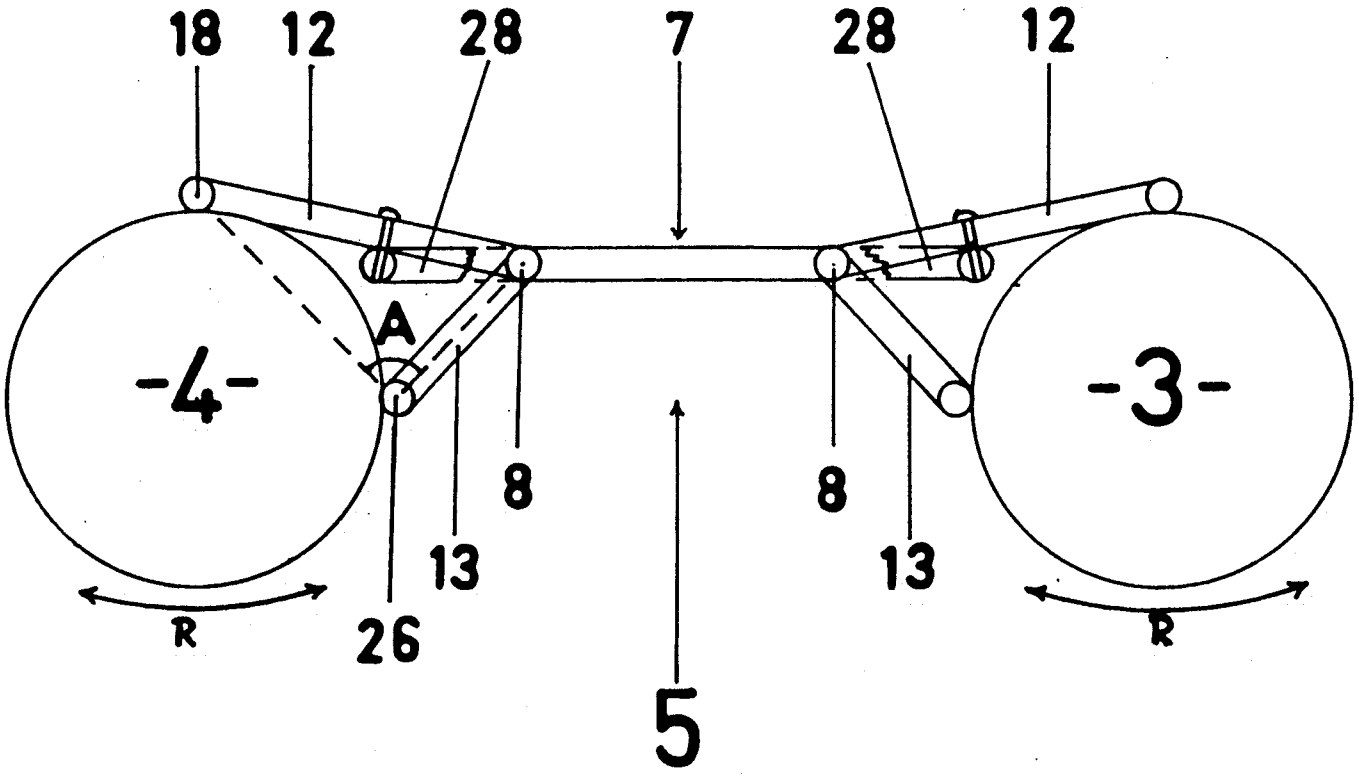
FIG. 2 is a schematic end view of the frame of FIG. 1, with part of the front stay cut away for clarity.

Referring to FIGS. 1 and 2 a catamaran 2 comprises two inflated hulls in the form of tubes 3, 4, connected together by a frame 5, which also provides a seat.

The frame 5 comprises a rectangular inner frame 7 made from two parallel longitudinal members 8 rigidly secured (e.g. by welding) to two parallel transverse members 9. The length of the longitudinal member 8 is approximately the equal to the overall length of the frame. A third transverse member 10 is rigidly secured between the longitudinal members 8, at about the midpoint of the members 8, to form part of a support for a seat panel 11 which is lashed to the longitudinal members 8 and the transverse members 9 and 10.

To each of the longitudinal members 8, first and second side frames 12, 13, are pivoted. Each of the first side frames 12 comprises two parallel members 14, 15, one end of each said member being secured to a collar 16, 17, which is mounted on the corresponding longitudinal member, adjacent the corresponding end of said member, upon a self-lubricating plastics bearing (not visible). The other end of each member 14, 15, is rigidly secured to a longitudinal member 18, which is secured by lacing to parallel skirts (not shown) formed along the length of the upper surface of each tube 3, 4 or strapped to D-rings secured to the tubes. Rowlock (oarlock) mountings (not shown) are secured to the members 18.

Each of the second side frames 13 comprises two opposed members 21, 22, shorter than said members 14, 15, one end of each member 21, 22, being secured to a collar 23, 24 which is mounted on the corresponding longitudinal member 8, inwards of said collars 16, 17. The collars 23, 24, are mounted upon a self-lubricating plastics bearing (not shown).

The other end of each member 21, 22 is rigidly secured to a longitudinal member 26, which is parallel to the longitudinal member 8, and is secured by lacing to parallel skirts (not shown) formed along the length of one side of each tube 3, 4 or strapped to D-rings secured to the tubes.

The position of the first and second pairs of side frames relative to the tubes 3, 4, and to each other is important in stabilising the tubes and preventing or at least discouraging rotation of the tubes towards or away from the frame (arrows R in FIG. 2). For this reason, the members 18 of the first pair of frames 12 should be secured to the upper surface of the corresponding tube 3, 4, preferably along the top of the tube. Preferably, the first pair of frames 12 should transfer to the tubes almost the total load placed on the inner frame. Also, the members 26 of the second pair of frames advantageously are spaced well below the members 18, so that the distance between the members 18 and 26 is equal to at least one hull radius measured around the surface of said hull. If the members 26 are attached to the respective tubes such that the angle between a line passing through the attachment locations of the members 18 and 20 and a line taken through the securement position of the second pair of side frames and the pivotal connection of said side frame to said inner frame (angle A in FIG. 2) in the range 70°–110°, the second pair of frames will stabilise the tubes 3, 4 without the frames being fixed in position relative to the inner frame. This spacing of the securement positions of the first and second side frames effectively stabilises the tubes relative to the frame, (and hence stabilises the catamaran as a whole) without the necessity of locking the second side frames relative to the inner frame.

The second side frames 13 are left free to pivot on the corresponding member 8, but the first side frames 12 are locked rigidly in position by means of a pair of stays 28, 28*a* secured one across each end of the frame.

The stay 28 comprises a first portion 29 greater in length than the transverse member 9 and having its ends 30 curved through 180°.

The stay 28*a* comprises a first portion 29*a* greater in length than the transverse members 9 and having its ends curved through 90 degrees. A straight portion 30*a* is secured to the free end of each curved portion, and extends parallel to the portion 29*a*.

At the end of the frame adjacent the seat panel 11, the portion 29 of the stay 28 is secured parallel to the adjacent transverse member 9 by a pair of spaced brackets 31 which are secured to the portion 29 and are a press-fit over said member 9. The free end of each portion 30 is fitted with a flange 32 which is bolted to the corresponding longitudinal member 8. In addition, each curved end of the portion 29 is arranged to pass underneath the member 14 of the corresponding first side frame 12, and is bolted thereto.

At the other end of the frame, the stay 28*a* is secured in substantially the same manner as the stay 28, except that each end is secured to the underside of the longitudinal member 8, and optionally spacers 33 may be inserted on the bolts securing the curved ends of the portion 29*a* to the members 15, to space the stay 28*a* further below the said frame 12 than at the seat-panel end of the frame, so that the stay 28*a* can form or support foot-rests below the main plane of the frame.

It will be appreciated that each stay 28, 28*a* is secured by only four bolts and two push-fit brackets, ensuring that both stays can be quickly and easily fitted and removed. Clips or other suitable securing means may be used instead of bolts, if preferred.

To fold up the catamaran, the stays 28, 28*a* are removed from the frame, as described above. The tubes 3, 4, are then deflated. Each of the side frames 12, 13, on one side of the frame is pivoted as indicated by the arrow in FIG. 3, until one first and one second side frame rest upon the upper surface of the frame 7, and the associated tube is then folded on top of said side frames. The frame is then inverted, and the other side frames 12, 13 are pivoted to rest on the frame 7, in the same manner, and the other tube is folded on top of the associated side frames. In this position, the frame is small enough to store or transport relatively easily.

Figure 3B:
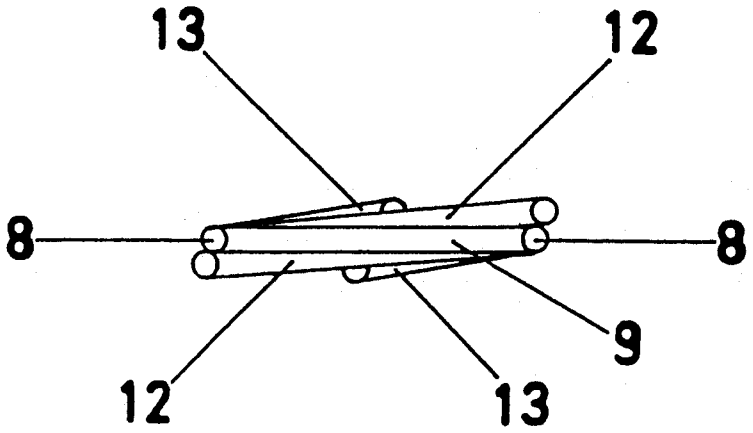
FIGS. 3*a* and 3*b* are end views of the frame of FIGS. 1 and 2 in the partly folded and completely folded states, respectively.
Figure 3A:
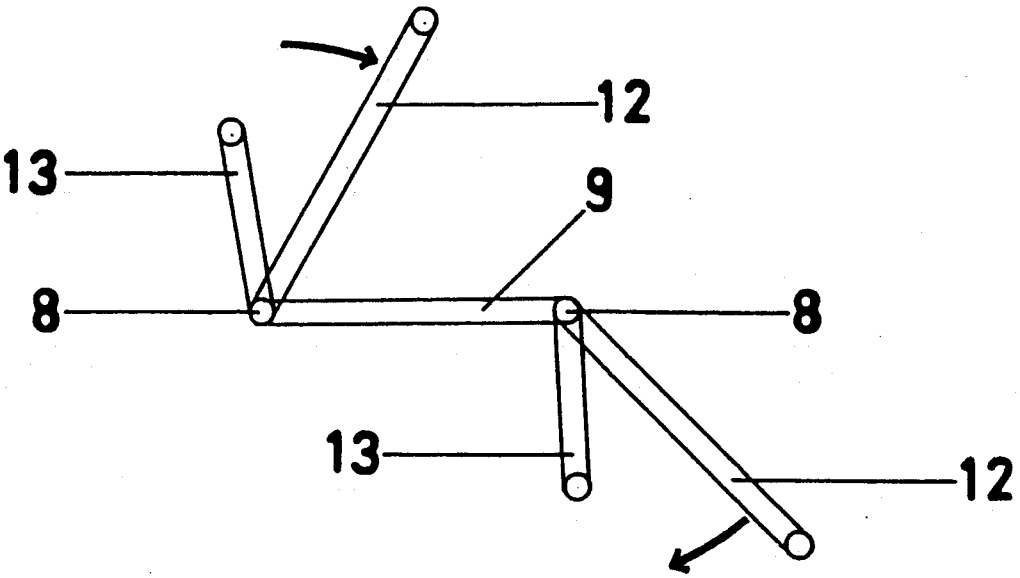

In the embodiment of FIG. 1-3, the side frames 12 are substantially the same dimensions as the inner frame 7. However, if necessary the frame 7 could be made wider than the side frames 12, and each transverse member 9, 10 of the frame hinged so that the inner frame itself can be folded. The stays 28, 28*a* would hold the transverse member 9 straight in use, but the transverse member 10 would require an additional stay to be secured across the hinged portion in use.

Figure 4B:
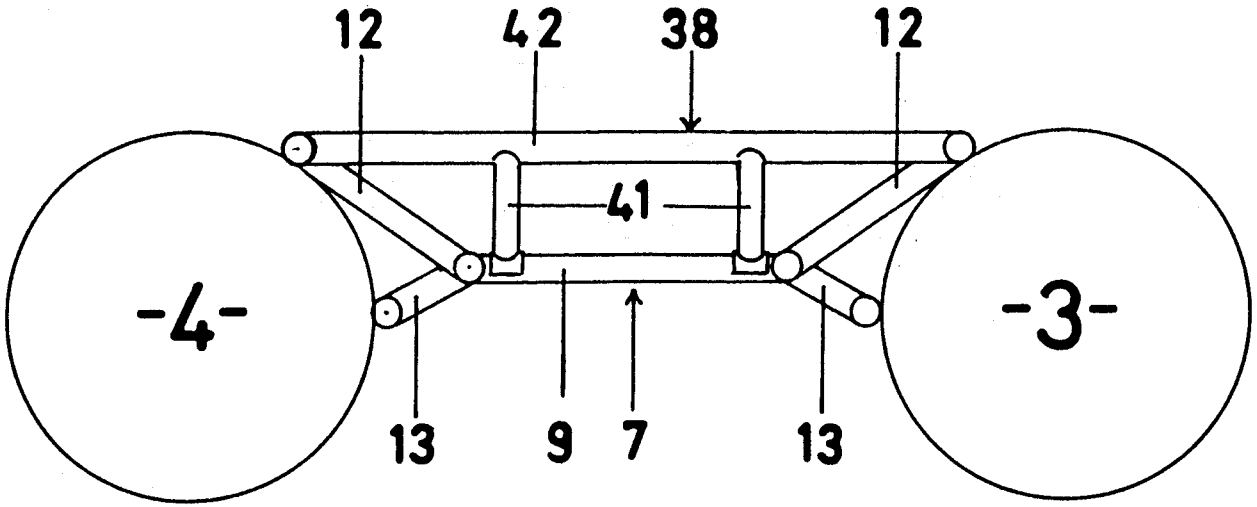
FIGS. 4*a* and 4*b* are schematic end views of the frame of a further embodiment of the invention.
Figure 4A:
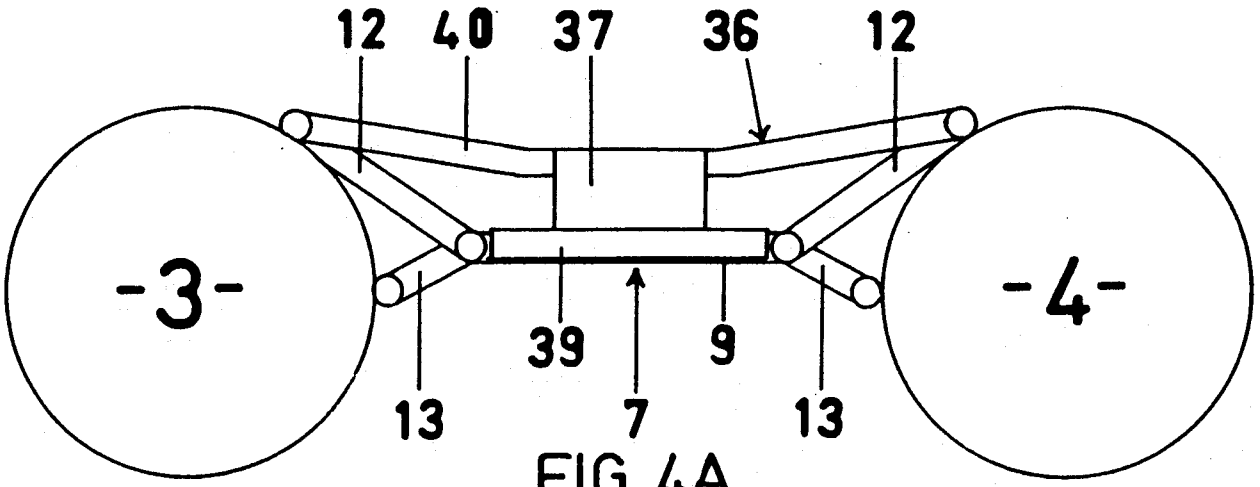

A further embodiment of the invention is shown in FIGS. 4*a* and 4*b*.

In FIGS. 4*a* and 4*b*, the construction and arrangement of the inner frame 7 and side frames 12, 13, is broadly similar to that of FIG. 1, except that the inner frame 7 is secured at a lower level relative to the tubes 3, 4, to form a support for a floor, (instead of a seat support, as in FIG. 1). The side frames 12 are attached to the inner sides of the tubes 3, 4, rather than to the upper surfaces, leaving the upper surfaces clear to be used for seating.

Instead of the stays 28, 28*a* used in the FIG. 1 embodiment, the frame is rigidified by stays 36, 38, which are rigidly secured between the side frames 12, one at each end of the frame.

The stay 36 comprises an arm 40, the ends of which are secured one to each of the frames 12, and a central saddle 37 the lower edge of which ends in a U-shaped bracket 39 which is press-fitted over the member 9. The support 37 provides a strong-point to which an outboard can be secured.

The stay 38 is similar to the stay 36, except that two spaced stays 41 extending between the arm 42 and the member 9, replace the saddle 37.

The arms 40, 42 are U-shaped in plan, and the free ends of the arms are arranged to plug into the open ends of the side frames 12, and are secured in place with quick-release pins. Thus the stays 36, 38 can be quickly and easily assembled and disassembled.

I claim:

1. A frame for an inflatable catamaran of the type including two spaced inflatable elongated hulls of substantially circular cross section, each hull having a lower surface which normally is submerged in use and an upper surface which normally is not submerged in use; said frame comprising: an inner frame which includes two spaced elongated members forming the sides of said inner frame and two spaced cross-members connecting said sides together; and first and second pairs of side frames, each side frame including an elongated member which in use extends parallel to the length of the adjacent inflatable hull; one of the side frames of the first pair of side frames is pivoted to one of said sides of said inner frame and the remaining side frame of the first pair of side frames is pivoted to the other side of said inner frame; one of the side frames of the second pair of side frames is pivoted to one of said sides of said inner frame and the remaining side frame of the second pair of side frames is pivoted to the other side of said inner frame; each side of said inner frame providing a common pivot axis fort the side frames pivoted to that side; the elongated members of the first pair of side frames being securable one to each of the upper surfaces of the catamaran hulls; and each elongated member of the side frames of the second pair being securable one to each of the catamaran hulls at a position below the securement position of said first pair of side frames; and means for releasably locking said first pair of side frames in position relative to said inner frame.

2. The frame as claimed in claim 1, wherein the securement position of each of the second pair of side frames is a distance from the securement position of the first pair of side frames equal to at least the radius of said hull, said distance being measured around the surface of said hull.

3. The frame as claimed in claim 2, wherein said inner frame is substantially rectangular in plan with said two cross-members arranged one adjacent each end of the elongated members.

4. The frame as claimed in claim 2, wherein the angle between a line taken through the securement positions of adjacent side frames of the first and second pairs of side frames on each side of the frame and a line taken through the securement position of said side frame of the second pair of side frames and the pivotal connection of said side frame of said second pair of side frames to said inner frame is in the range of 70°-110°.

5. The frame as claimed in claim 1, wherein said inner frame is substantially rectangular in plan with said two cross-members arranged one adjacent each end of the elongated members.

6. The frame as claimed in claim 1, wherein said locking means comprise a pair of stays secured between the inner frame and said first pair of side frames.

7. The frame as claimed in claim 6, wherein the side frames pivoted to one side of the inner frame are dimensioned and arranged so as to be pivotable to a position in which said side frames lie adjacent the upper surface of the inner frame, and the side frames pivoted to the other side of the inner frame are dimensioned and arranged so as to be pivotable to a position in which said side frames lie adjacent the lower surface of the inner frame.

8. The frame as claimed in claim 1, wherein said locking means comprises a pair of stays each comprising an arm rigidly secured at each end to the adjacent first side frame and a rigid spacer extending between said arm and the inner frame.

9. The frame as claimed in claim 8, wherein the side frames pivoted to one side of the inner frame are dimensioned and arranged so as to be pivotable to a position in which said side frames lie adjacent the upper surface of the inner frame, and the side frames pivoted to the other side of the inner frame are dimensioned and arranged so as to be pivotable to a position in which said side frames lie adjacent the lower surface of the inner frame.

10. The frame as claimed in claim 1, wherein the side frames pivoted to one side of the inner frame are dimensioned and arranged so as to be pivotable to a position in which said side frames lie adjacent the upper surface of the inner frame, and the side frames pivoted to the other side of the inner frame are dimensioned and arranged so as to be pivotable to a position in which said side frames lie adjacent the lower surface of the inner frame.

11. The frame as claimed in claim 1, wherein said frame further provides a mounting bracket for an outboard motor.

12. An inflatable catamaran comprising the combination of two spaced inflatable elongated hulls of substantially circular cross section, each hull having a lower surface which normally is submerged in use and an upper surface which normally is not submerged in use; secured together by a frame comprising: an inner frame which includes two spaced elongated members forming the sides of said inner frame and two spaced cross-members connecting said sides together; and first and second pairs of side frames, each side frame including an elongated member which extends parallel to the length of the adjacent inflatable hull; one of the side frames of the first pair of side frames is pivoted to one of said sides of said inner frame and the remaining side frame of the first pair of side frames is pivoted to the other side of said inner frame; one of the side frames of the second pair of side frames is pivoted to one of said sides of said inner frame and the remaining side frame of the second pair of side frames is pivoted to the other side of said inner frame; each side of said inner frame providing a common pivot axis for the side frames pivoted to that side; the elongated members of the first pair of side frames being secured one to each of the upper surfaces of the hull and each elongated member of the side frames of the second pair being secured one to each of the hulls at a position below the securement position of said first pair of side frames; and means for releasably locking said first pair of side frames in position relative to said inner frame.

13. The catamaran as claimed in claim 12, wherein the securement position of each of the second pair of side frames is a distance from the securement position of the first pair of side frames equal to at least the radius of said hull, said distance being measured around the surface of said hull.

14. The catamaran as claimed in claim 13, wherein the angle between a line taken through the securement positions of adjacent side frames of the first and second pairs of side frames on each side of the frame and a line taken through the securement position of said side frame of the second pair of side frames and the pivotal connection of said side frame of said second pair of side frames to said inner frame is in the range of 70°–110°.

15. The catamaran as claimed in claim 12, wherein the side frames pivoted to one side of the inner frame are dimensioned and arranged so as to be pivotable to a folded position in which said side frames lie adjacent the upper surface of the inner frame, and the side frames pivoted to the other side of the inner frame are dimensioned and arranged so as to be pivotable to a folded position in which said side frames lie adjacent the lower surface of the inner frame.

16. The catamaran as claimed in claim 15, wherein said inflatable tubes can be inflated or deflated when said side frames are pivoted to said folded position.

17. In a collapsible inflatable catamaran of the type including a pair of spaced elongated hulls, the improvement in a framework comprising:

an inner frame inclusive of two spaced elongated members forming the sides of the inner frame and two spaced cross-members connecting the sides together, first and second pairs of side frames with each side frame being inclusive of an elongated member extendable in parallelism with the length of an adjacent hull, with one side frame of each pair being pivoted to one of the sides of the inner frame and the other side frame of each pair being pivoted to the other of the sides of the inner frame, with each side forming a pivot axis, the elongated members of the first pair of side frames being securable one to each of the upper surface of a catamaran hull, each elongated member of the side frames of the second pair being securable one to each catamaran hull at a position below the securement position of the first pair of side frames, and means for releasably locking the first pair of side frames in position relative to the inner frame.

* * * * *